US005326081A

United States Patent [19]

Arpalahti

[11] Patent Number: 5,326,081

[45] Date of Patent: Jul. 5, 1994

[54] METHOD AND APPARATUS FOR COOLING HOT GASES

[75] Inventor: Olli E. Arpalahti, Varkaus, Finland

[73] Assignee: A. Ahlstrom Corporation, Noormarkku, Finland

[21] Appl. No.: 958,124

[22] PCT Filed: Jul. 1, 1991

[86] PCT No.: PCT/FI91/00205

§ 371 Date: Dec. 28, 1992

§ 102(e) Date: Dec. 28, 1992

[87] PCT Pub. No.: WO92/01202

PCT Pub. Date: Jan. 23, 1992

[30] Foreign Application Priority Data

Jul. 4, 1990 [FI] Finland ..... 903358

[51] Int. Cl.[5] ..... F27D 17/00

[52] U.S. Cl. ..... 266/44; 266/155

[58] Field of Search ..... 266/44, 143, 155, 148

[56] References Cited

U.S. PATENT DOCUMENTS

| | | | |
|---|---|---|---|
| 3,170,017 | 2/1965 | Namy | 266/155 |
| 4,087,274 | 5/1978 | Edenwall et al. | 75/10 R |
| 4,114,862 | 9/1978 | Denjean | 266/44 |
| 4,273,074 | 6/1981 | Kuhlmann | 122/7 R |
| 4,362,129 | 12/1982 | Banfi et al. | 122/7 R |
| 4,475,947 | 10/1984 | Andersson | 266/155 |
| 4,541,864 | 9/1985 | Ratschat | 266/155 |

FOREIGN PATENT DOCUMENTS

| | | |
|---|---|---|
| 1027499 | 7/1983 | U.S.S.R. . |
| 2064749 | 6/1981 | United Kingdom . |

*Primary Examiner*—Scott Kastler

*Attorney, Agent, or Firm*—Nixon & Vanderhye

[57] ABSTRACT

A method and apparatus for cooling the exhaust gases from a molten phase furnace, such as a smelting furnace. The exhaust gases are conveyed from the furnace to a vertically extending cooling shaft disposed above the furnace, where the exhaust gases are indirectly cooled by means of a cooling gas in a circulating system. From the cooling shaft, the exhaust gases are conveyed to a waste heat boiler, where heat is recovered from the exhaust gases as saturated or superheated, pressurized steam.

21 Claims, 3 Drawing Sheets

METHOD AND APPARATUS FOR COOLING HOT GASES

The present invention relates to a method and apparatus for cooling the exhaust gases from a molten phase furnace, such as a smelting furnace. The exhaust gases are conducted from the furnace via a vertical cooling shaft into a waste heat boiler, where heat is recovered from the gases either as saturated or superheated, pressurized steam. The steam is utilized for electricity generation.

The present invention is especially suitable for cooling of exhaust gases from smelteries, for example, from the melting processes of metal sulphides. It is also applicable to other processes in which hot, dirty gases have to be cooled and in which water-cooled surfaces may constitute a risk.

The exhaust gases from metal smelteries are typically hot gases of 1,100° to 1,400° C. containing solid particles, dust partly in a molten form, and gas components which condense to a solid phase when cooled to a temperature of, for example, 200° to 400° C.

To meet the environmental requirements, such gases usually have to be cooled to a sufficiently low temperature prior to further treatment. As smelteries use sulphide as a raw material and the sulphur contained therein is transferred to the gas phase as sulphur dioxide ($SO_2$) in the oxidation stage after melting, the $SO_2$ content of the gases normally rises significantly, to a level of 7 to 15% or even higher if air is replaced by oxygen in the melting stage.

A conventional gas treatment of such a process comprises the steps of first cooling the gas in a waste heat boiler which generates saturated, sometimes superheated steam and then, after the boiler, separating solids from the gas, for example, by an electrofilter. The gas cleaned of solids is then conveyed to a sulphuric acid plant in which $SO_2$ contained in the gas is used as a raw material. The steam boiler is used because it facilitates electricity generation for the smeltery by means of a steam turbine. Usually, electricity is generated in excess and the surplus is sold.

Most smelting processes of metal sulphides employ a smelting furnace structure in which the easiest and simplest way of discharging the exhaust gases is to lead them upwards and to discharge them through an opening in the furnace roof. For example, Finnish patent specification 65632 and U.S. Pat. No. 4,087,274 propose smelting furnaces where the exhaust gases are discharged through an opening in the furnace roof.

However, this arrangement involves a risk if the steam boiler and the first heating surfaces thereof are disposed above the smelting furnace, extending straight upwards form the opening in the furnace roof. Bursting of a boiler tube in such a structure and the leak of water caused thereby would expose the smelting furnace to a danger of explosion, as water spraying from the leaking point automatically comes into contact with the molten material in the furnace.

A boiler arranged above a furnace could be provided with a superheater, i.e. with steam not water cooled heating surfaces. In that case, the portion above the furnace would constitute a superheater and the dangerous evaporating surfaces containing boiler water could be located farther off. However, this is impossible in practice for the following reasons:

one of the biggest problems encountered in cooling the gases is that dust particles stick to the heating surfaces, whereby the surfaces tend to become clogged and the heat transfer decreases remarkably. A rise in the surface temperature makes the phenomenon still worse. Therefore, the heating surfaces in such boilers are usually constructed to give an as high cooling effect as possible while generating saturated steam. They are not constructed as hot superheater surfaces. If necessary, the steam generated in these boilers is superheated in a separate superheating boiler arranged in front of the steam turbine.

at steam pressures in question (below 100 bar), the thermal energy for superheating is too low, when compared with the thermal energy for evaporation, to provide a cooling effect by superheaters only in that portion of the boiler which is arranged immediately above the furnace. A steam pressure exceeding 100 bar would, on the other hand, result in the temperature of the evaporating surfaces rising too high in view of cleaning.

A conventional boiler arrangement used in these smelteries is a horizontal boiler arranged at a side of the smelting furnace, thereby avoiding the risk of explosion caused by water leaks. A similar boiler arrangement is used, e.g., in a smelting process disclosed in U.S. Pat. No. 4,073,645. The arrangement has proved to operate well, but the boiler structure is expensive and space consuming, and the total effect of the arrangement thereby remarkably increases the price for gas treatment.

An object of the present invention is to provide an improved method and apparatus in comparison with those described hereinabove for cooling the exhaust gases from smelting or combustion furnaces, and especially to provide an arrangement which is safe in operation.

Another object of the invention is to provide a simple apparatus consuming as little space as possible for cooling of exhaust gases.

A further object of the invention is to provide an economic method for heat recovery from the exhaust gases, in which method the heat of the hot gases may be optimally utilized and the temperature of the exhaust gases be lowered to a level required for gas cleaning.

A still further object of the invention is to provide an arrangement which both improves the safety in operation and ensures the electricity self-sufficiency of the smeltery or substantially contributes thereto.

The method according to the invention for providing the objects of the invention is characterized in that exhaust gases are cooled in the cooling shaft by cooling said cooling shaft with gas. Cooling is preferably effected by means of gas circulation using uncondensable gas, such as air or nitrogen. The heat transferred from the exhaust gas to the cooling gas during the cooling stage may be employed in preheating the boiler water in the waste heat boiler and in heating and/or evaporating the condensated steam in the steam circulation. According to the invention, exhaust gases are cooled in two stages and by means of two different heat transfer mediums. In the first stage, exhaust gases are cooled in the cooling shaft where gas is used as a cooling medium. In the second stage, heat is recovered in the waste heat boiler by using water and water vapor as a heat transfer medium.

The apparatus according to the invention is characterized in that heat transfer surfaces are disposed in the cooling shaft for indirect cooling of the shaft by means of gas. The cooling shaft is preferably in communication with a cooling gas circulation system, which comprises

- heating surfaces in the cooling shaft for transferring heat from the exhaust gas to the cooling gas,
- a heat exchanger for cooling the cooling gas,
- tubes for transferring the cooling gas from the cooling shaft to the heat exchanger,
- tubes for transferring the cooling gas from the heat exchanger to the cooling shaft, and
- a circulation fan for circulating the cooling gas in the gas circulation system.

The cooling shaft in accordance with the invention may be arranged directly above the furnace in alignment with the opening the furnace roof. In such case, the exhaust gases rise upwardly in the furnace and directly enter the cooling shaft. The waste heat boiler is preferably disposed next to the shaft and the furnace. In the cooling shaft, the heating surfaces are arranged so as to effect the heat transfer in the form of radiation heat transfer. The shaft walls may be composed e.g. of heat transfer surfaces wherein gas flows. The waste heat boiler is provided with convection heat transfer surfaces.

The boiler arrangement according to the invention comprises two sections, wherein a vertical, shaft type section is disposed above the furnace, for cooling the gases to a temperature range of 600° to 900° C. An optimal temperature depends on the process and the smeltery and, exceptionally, it may even be outside the above-mentioned temperature range. After-cooling of gases, normally to a temperature range of 330° to 380° C., takes place in a boiler section arranged next to the vertical section and communicating therewith, at the side of the furnace. The boiler section is primarily provided with convective heat transfer surfaces. In the vertical shaft, heat transfer is primarily based on radiation.

In the arrangement according to the invention, only the latter section, i.e. the waste heat boiler, is constructed for the generation of saturated or slightly superheated, pressurized steam. The pressure of the steam generated is typically 25 to 80 bar.

The shaft section is cooled by means of pressurized, uncondensed gas, inert with respect to the process, such as air or nitrogen. The temperature range of the gas in the cooler is adjusted to be suitable for the temperature of the heating surface so as to minimize fouling of the heating surfaces. The temperature of the surface in contact with the gas to be cooled depends on the process conditions. When, for example, gas with a high $SO_2$ content (10 to 15%) is cooled, the temperature is preferably 250° to 320° C.

Cooling of the exhaust gas in the shaft is brought about by the cooling system formed by the cooling gas circulation system. The cooling system comprises

- a heating surface of the shaft
- a cooler/coolers for the circulating gas
- a circulation fan
- a pressure compressor, and
- circulation tubes.

As no phase alteration is involved in the gas cooling, the mass flows of the gas circulation normally become large in volume. If the gas is unpressurized, the circulating volume flow is very big. It may be reduced adequately by pressurization, whereby the power consumption of the circulation gas fan remains at a reasonable level.

Another advantage, even possible necessity, gained by pressurization is that the heat transfer resistance of the heating surface of the shaft on the gas circulation side is sufficiently lowered. Heat transfer is remarkably improved by pressurizing the gas, and the temperature of the heat transfer surface approaches the temperature of the circulation gas. In this manner, the temperature of the heating surfaces in the shaft is controllable. This is very important because strong radiation, prevailing in the shaft is capable of raising the surface temperature to a harmful level in spite of the scaling phenomenon unless the surface is sufficiently cooled. An adequate pressure level is $>15$ bar, preferably 15 to 25 bar.

Unless utilized, the heat transferred to the gas circulation is wasted. The heat is preferably utilized by heating both the boiler feed water for the steam circulation and the cold condensate discharged from the turbine condenser. The steam power of the boiler is thereby increased and correspondingly the electricity generation. Whether an investment in a preheater is worthwhile, depends on the smeltery and, locally, it depends on the electricity requirement and the electricity price.

An advantage of the arrangement of the invention resides in that a leak in the vertical section, i.e., the shaft, discharging gas into the shaft neither endangers the smelting conditions nor the safety of the personnel at the smeltery. Furthermore, the arrangement according to the invention is easy to accomplish and its space requirement is relatively low. At the same time, it also facilitates sufficient electricity generation from recovered heat.

When compared with direct cooling by cold gas, an advantage of indirect cooling of exhaust gas in accordance with the invention is that the arrangement of the invention brings about much smaller gas volumes, thereby benefiting the gas cleaning. Addition of gas to a hot exhaust gas flow may also be problematic; even keeping the gas nozzles open may be difficult.

The solid material separated from the gas cooled by the method according to the invention may simply be returned to the smelting furnace with no need for any special measures because neither the exhaust gas nor the solid material has been treated directly with any substance which could be harmful when brought into contact with melt.

BRIEF DESCRIPTION OF THE DRAWINGS

The invention is further described in the following, by way of example, with reference to the accompanying drawings, in which

FIG. 1 shows a two-stage arrangement for cooling exhaust gases from a smelting furnace 10. In the first stage 12, exhaust gas is cooled by a gas circulation system 14 and in the second stage 16, heat is recovered from the exhaust gas in a steam boiler 18.

Figure 1:
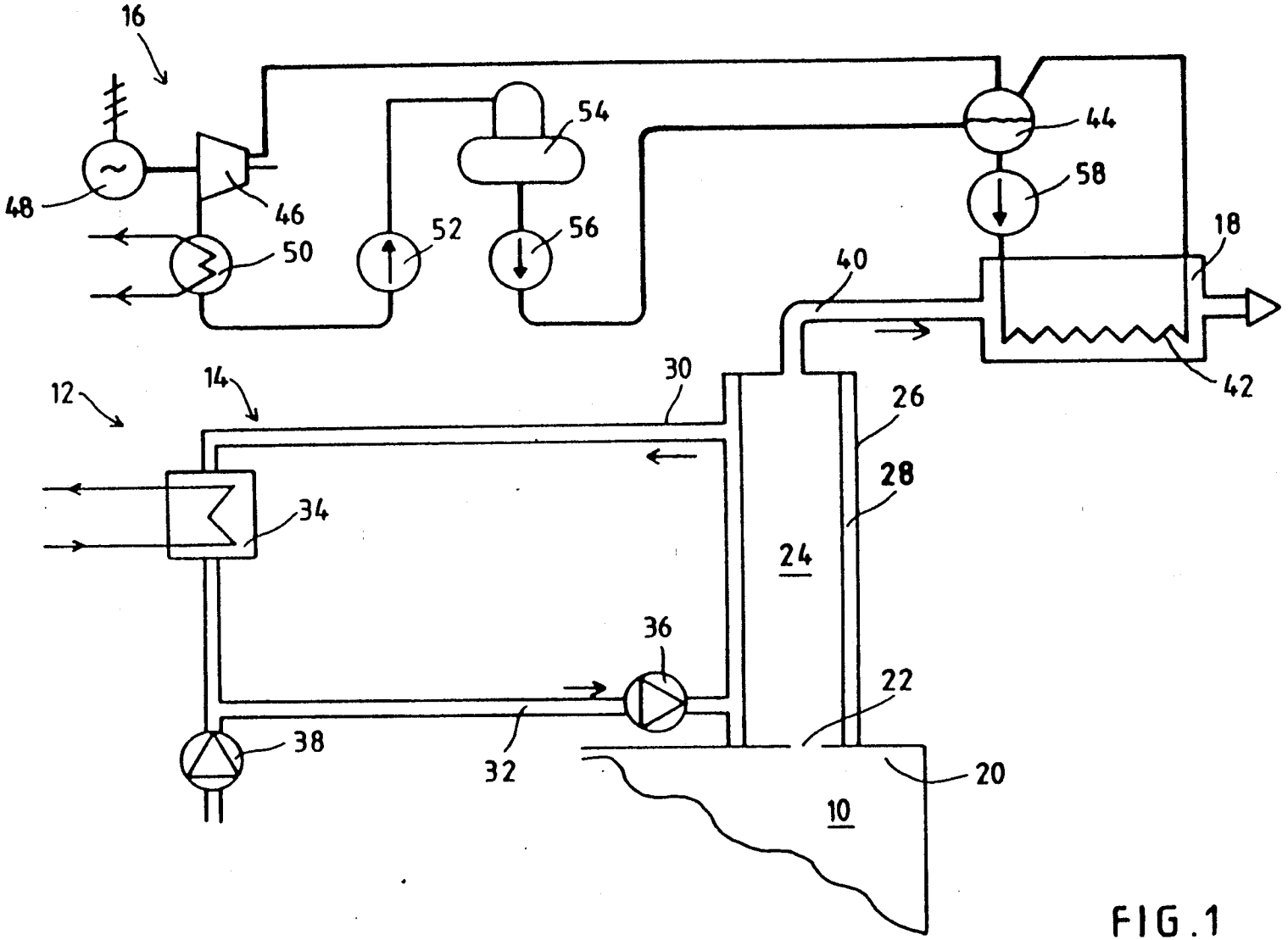
FIG. 1 is a schematic illustration of an arrangement for cooling exhaust gas in accordance with the invention.

The roof 20 of the smelting furnace 10 is provided with an opening 22, wherethrough the first cooling stage in the smelting furnace is in communication with a vertical cooling shaft 24. The exhaust gases flow via the opening in the furnace roof into the shaft 24 and further to the steam boiler 18 in the second stage.

The walls 26 of the shaft 24 are composed of heat transfer tubes 28, wherein pressurized cooling gas, such as air, nitrogen or other inert, uncondensed gas, flows. The heat transfer tubes form a radiation heat exchanger in the shaft.

The gas tubes 28 in the shaft are connected by circulation gas tubes 30 and 32 to a heat exchanger 34, where the gas circulation, i.e. the cooling gas heated in the shaft, is cooled. Gas is circulated in the circulation gas system by a circulation gas fan 36. A pressure of >15 bar is maintained in the circulation gas system by means of a pressure compressor 38. In the example, the circulation gas is heated, for example, to about 300° C. in the shaft and is cooled, for example, to about 220° C. in the heat exchanger.

In the example of FIG. 1, the heat recovered by cooling of the shaft is recovered in the gas circulation system which is provided with one heat exchanger. The heat recovered in the shaft is not, in the example shown in FIG. 1, employed for electricity generation. Electricity is only generated by the heat recovered in the steam boiler 18 in the second heat recovery stage.

The cooling shaft 24 is connected to the steam boiler 18 by means of a tube 40. In the steam boiler, heat is recovered from the exhaust gases primarily by convection heat transfer surfaces 42. In the example, saturated steam of 40 bar is conducted from the steam drum 44 of the steam boiler into a steam turbine 46. A generator 48 connected to the steam turbine generates electricity. The steam discharged from the turbine is condensed in a condenser 50 and conducted by means of a condense pump 52 into the feed water tank 54 of the boiler. From the feed water tank, the feed water is returned by means of a feed water pump 56, at a pressure of 40 bar and at a temperature of 105° C. to the steam drum and further, by means of a boiler circulation pump 58, to the heat transfer tubes 42 of the boiler.

Figure 2:
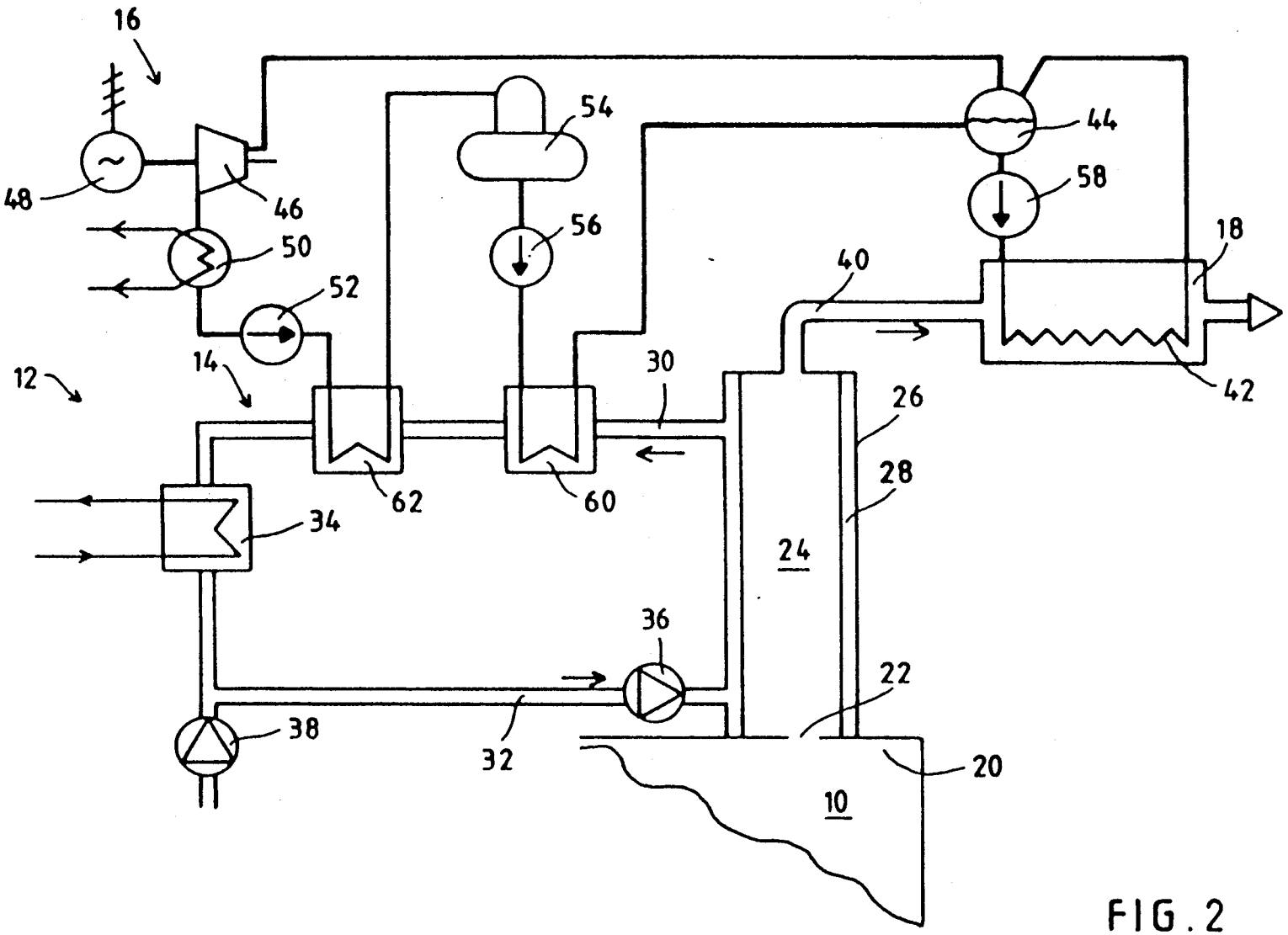
FIG. 2 and 3 are schematic illustrations of two other arrangements for cooling exhaust gas in accordance with the invention.

In the arrangement shown in FIG. 2, part of the heat recovered to the gas circulation system is utilized in the steam system. The elements coinciding with those in FIG. 1 are identified by the same reference numerals. Deviating from the arrangement of FIG. 1, the arrangement of FIG. 2 provides that the boiler feed water is led from the feed water tank 54 by means of the feed water pump 56 into the tubes 30 of the circulation gas system, and more specifically, into the preheater 60 of the feed water, said preheater being disposed in front of the heat exchanger 34. The feed water is heated to a temperature of 230° C. in the preheater. The cold condensate discharged from the turbine condenser 50 is also heated by utilizing the heat of the circulation gas system. A condensate heater 62 is disposed between the feed water preheater 60 and the heat exchanger in the circulation gas tubes 30. The heat exchanger 34 takes care of the final cooling of the circulating gas. The arrangement of FIG. 2 is capable of increasing the steam power of the boiler and consequently, the electricity generation.

Figure 3:
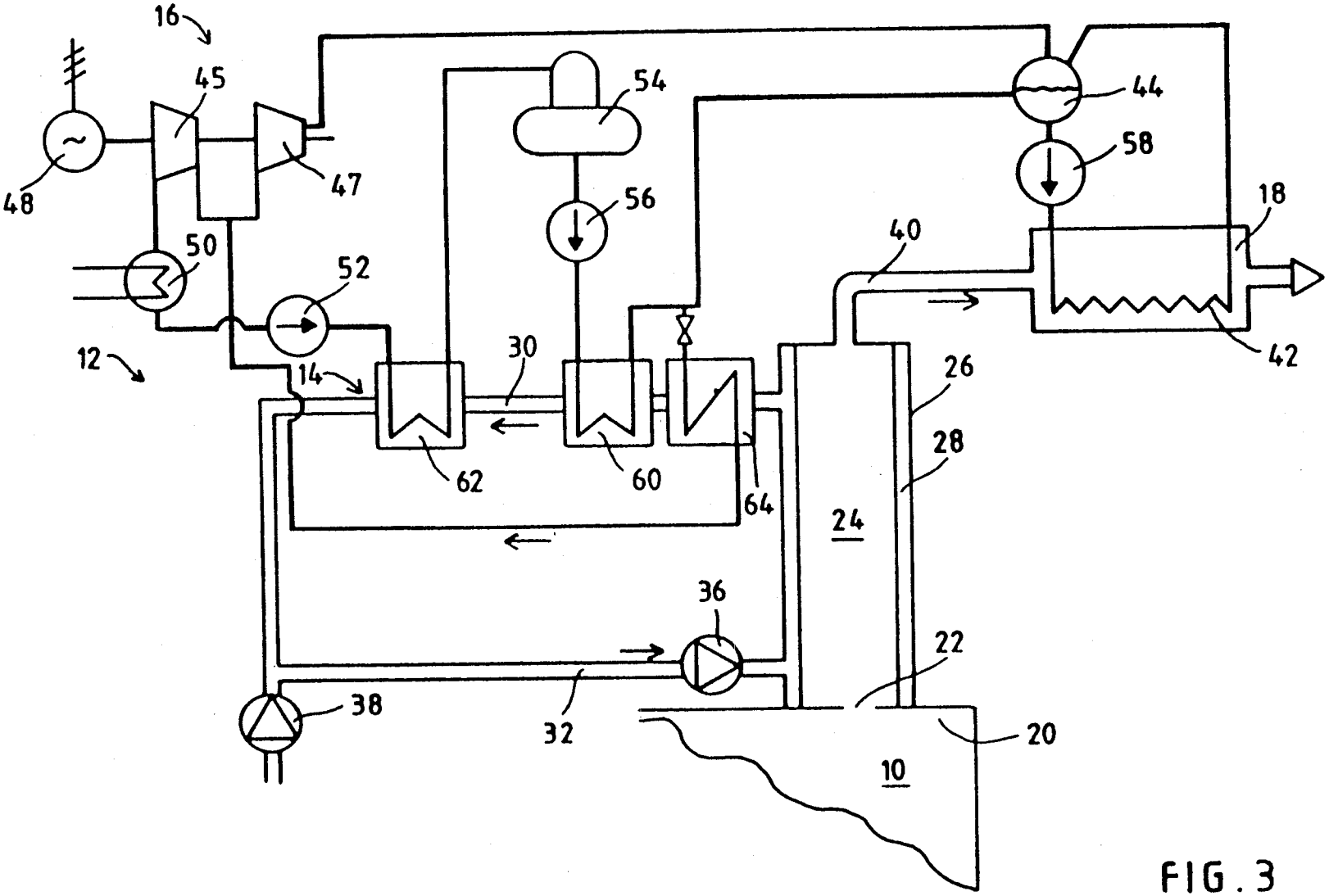

The arrangement of FIG. 3 utilizes the total heat recovered by cooling of shaft 24 for the electricity generation. Coinciding elements are also in this figure identified by the same reference numerals as in FIGS. 1 and 2. In addition to the feed water preheater 60 and the condensate heater 62, an evaporator 64 is disposed between the shaft 24 and the feed water preheater 60 in the circulation gas tubes 30. Water from the feed water preheater 60 is evaporated in the evaporator by means of the heat of the gas circulation system, whereby 20 bar low-pressure steam is generated. The low-pressure steam thereby generated is conveyed, as a steam mixture, together with the exhaust steam from the high-pressure section 47 of the turbine into the low-pressure section 45 of a 2-compartment turbine. High-pressure steam from the boiler is conducted into the high-pressure section 47 of the turbine. The feed water required by both the boiler and the gas circulation evaporator is circulated through the condensate heater and the feed water preheater.

The steam turbine in accordance with FIG. 3 is capable of generating about 4 MW of electricity if the heat recovered from the gases in the heat recovery system totals 15 MW, whereof the share of the steam boiler is 5 MW and the share of the shaft is 10 MW.

All arrangements of FIGS. 1–3 employ a turbine for saturated steam, at the discharge end of which turbine the allowed steam moisture is on the order of 20%. The volume and conversion efficiency of the electricity generation may also be raised to some extent by means of a superheating boiler.

According to process conditions, the arrangement of the invention is also adapted for superheating steam to a suitable degree in the steam boiler.

We claim:

1. A method of cooling exhaust gases from a molten phase furnace using a cooling shaft and waste heat boiler, comprising the steps of:

(a) conducting the exhaust gases upwardly via the cooling shaft into the waste heat boiler;

(b) recovering heat from the exhaust gases in the waste heat boiler in the form of saturated or superheated steam; and (c) positively cooling the gases in the cooling shaft by cooling the cooling shaft with circulating pressurized gas.

2. Apparatus for cooling exhaust gases from a molten phase furnace, comprising:

a molten phase furnace having a roof and a gas outlet disposed in said roof;

a waste heat boiler;

an upwardly extending cooling shaft disposed directly above said furnace and connected to said furnace gas outlet and to said waste heat boiler, and for conducting exhaust gases from said furnace to said boiler;

a steam turbine connected to said waste heat boiler;

heat transfer surfaces provided on said cooling shaft; and an essentially closed gas circulation system for circulating a cooling gas through said heat transfer surfaces, said gas circulation system comprising a pressure compressor for pressurizing the cooling gas, and heat exchanger means for cooling the cooling gas.

3. A method as recited in claim 1 wherein step (c) is practiced by cooling the cooling shaft with circulating pressurized uncondensed gas.

4. A method as recited in claim 1 wherein strep (c) is practiced by cooling the cooling shaft with circulating pressurized air or nitrogen.

5. A method as recited in claim 1 wherein the furnace comprises a melting furnace having a roof and an opening in the furnace roof, and wherein step (a) is practiced by conducting the exhaust gases directly upwardly from the furnace through an opening in the furnace roof to the cooling shaft.

6. A method as recited in claim 1 comprising the further step (d) of recovering heat from the pressurized gas used in step (c) utilizing a heat exchanger.

7. A method as recited in claim 1 wherein the waste heat boiler includes a preheater for feed water to the waste heat boiler; and comprising the further step (d) of recovering heat from the gas in step (c) utilizing the preheater for the waste heat boiler feed water.

8. A method as recited in claim 1 further utilizing a heater for condensate for the waste the boiler; and comprising the further strep (d) of recovering heat from the gas in step (c) using the heater for the waste heat boiler condensate.

9. A method as recited in claim 1 comprising the further step (d) of recovering heat from the pressurized gas of step (c).

10. A method as recited in claim 9 further utilizing an evaporator for water from the waste heat boiler; and wherein step (d) is practiced utilizing the evaporator for the water from the waste heat boiler.

11. A method as recited in claim 1 wherein in the practice of step (c) the exhaust gases are cooled to a temperature of between about 600°-900° C.; and wherein step (b) is practiced to cool the gases to a temperature of between about 330°-380° C.

12. A method as recited in claim 1 wherein step (c) is practiced by maintaining the pressure of the pressurized gas at about 15-25 bar.

13. A method as recited in claim 1 wherein the furnace comprises a metal smelting furnace, and wherein the waste heat boiler is disposed next to the smelting furnace; and comprising the further step of recovering heat from the exhaust gases of the smelting furnace, the heat being recovered in a first stage by recovering heat from the circulating gas in step (c), and the heat being recovered in a second stage as pressurized steam from step (b).

14. Apparatus as recited in claim 2 further comprising: at least one tube for conveying cooling gas from said cooling shaft to said heat exchanger means; at least one tube for conveying cooling gas from said heat exchanger means to said cooling shaft; and a circulation fan for circulating cooling gas in said circulation system.

15. Apparatus as recited in claim 2 wherein said waste heat boiler extends horizontally and is disposed next to the furnace, or laterally adjacent said gas outlet of said cooling shaft.

16. Apparatus as recited in claim 2 wherein said heat transfer surfaces provided on said cooling shaft comprise radiation heating surfaces; and wherein said waste heat boiler includes convection heating surfaces for generating pressurized steam.

17. Apparatus as recited in claim 2 wherein said heat transfer surfaces provided on said cooling shaft comprise wall surfaces of said cooling shaft.

18. Apparatus as recited in claim 14 wherein said gas circulation system further comprises a heat exchanger means for heating condensate from said steam turbine.

19. Apparatus as recited in claim 2 wherein said gas circulation system further comprises evaporating surfaces for generating steam for said waste heat boiler.

20. Apparatus as recited in claim 2 wherein said furnace comprises a metal smelting furnace; and wherein said waste heat boiler extends horizontally and generates superheated steam; and wherein said steam turbine comprises a two stage, low pressure and high pressure, steam turbine.

21. Apparatus as recited in claim 20 wherein said gas circulation system further comprises evaporating surfaces for generating steam for said low pressure turbine; preheater means for preheating water for said waste heat boiler; and heating means for heating condensate discharged from said turbine.

* * * * *